United States Patent [19]

Hösel et al.

[11] Patent Number: 4,813,615

[45] Date of Patent: Mar. 21, 1989

[54] METHOD AND APPARATUS FOR OPERATING A BALE OPENER, PARTICULARLY AS A FUNCTION OF THE BALE HEIGHT

[75] Inventors: Fritz Hösel, Mönchengladbach; Andreas Kranefeld, Erkelenz; Josef Temburg, Jüchen, all of Fed. Rep. of Germany

[73] Assignee: Trützschler GmbH & Co., KG, Mönchengladbach, Fed. Rep. of Germany

[21] Appl. No.: 695,611

[22] Filed: Jan. 28, 1985

[51] Int. Cl.[4] ..... B02C 25/00

[52] U.S. Cl. ..... 241/30; 241/33; 241/60; 241/101 A; 241/101.7

[58] Field of Search ..... 241/101 A, 30, 33, 34, 241/36, 37, 101.7, 60; 19/80 R, 80 A, 81, 145.5

[56] References Cited

U.S. PATENT DOCUMENTS

| | | | |
|---|---|---|---|
| 3,961,757 | 6/1976 | Berggren | 241/37 X |
| 4,172,515 | 10/1979 | Wochnowski | 241/36 X |
| 4,467,502 | 8/1984 | Litton et al. | 241/101 A X |
| 4,536,852 | 8/1985 | Hösel . | |

FOREIGN PATENT DOCUMENTS

| | | |
|---|---|---|
| 2310845 | 12/1977 | Fed. Rep. of Germany . |
| 3124569 | 1/1983 | Fed. Rep. of Germany . |
| 3135272 | 3/1984 | Fed. Rep. of Germany . |
| 636133 | 5/1983 | Switzerland . |

OTHER PUBLICATIONS

Promoli "Microelectronics in Preparatory Operations for Spinning", Melliand Textilberichte 1/1982, pp. 14–18.

*Primary Examiner*—Mark Rosenbaum
*Attorney, Agent, or Firm*—Spencer & Frank

[57] ABSTRACT

A bale opener includes a carriage arranged for a back-and-forth travel in a path along a fiber bale series; a tower supported on the carriage and a cantilever mounted on the tower and arranged for vertical displacements with respect to the tower, an opening device supported in the cantilever and arranged for removing fiber from the bale tops during travel of the carriage; a sensor assembly arranged for travel along the fiber bale series for emitting first signals characterizing bale heights; and a control device operatively connected to the sensor assembly for receiving the first signals. The sensor assembly comprises two sensors mounted on the tower or the cantilever and spaced vertically from one another. There is further provided a length position determining device for generating second signals representing longitudinal positions of the cantilever along the travel of the carriage. The length position determining device is connected to the control device for receiving the second signals.

16 Claims, 2 Drawing Sheets

FIG. 1
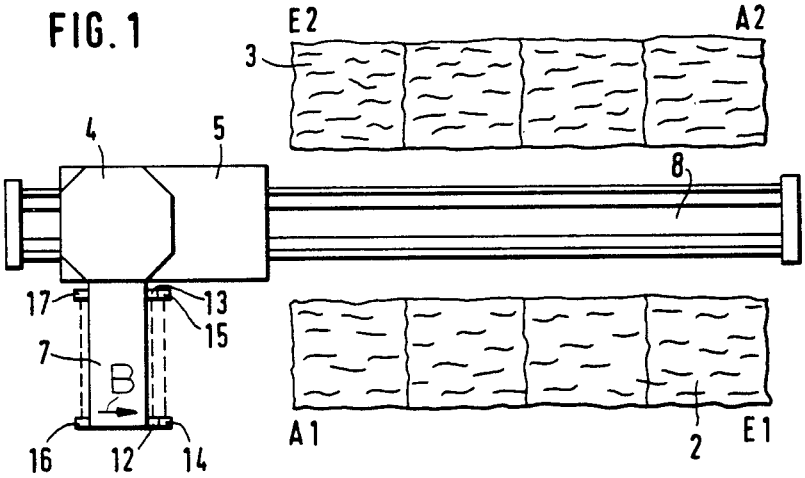
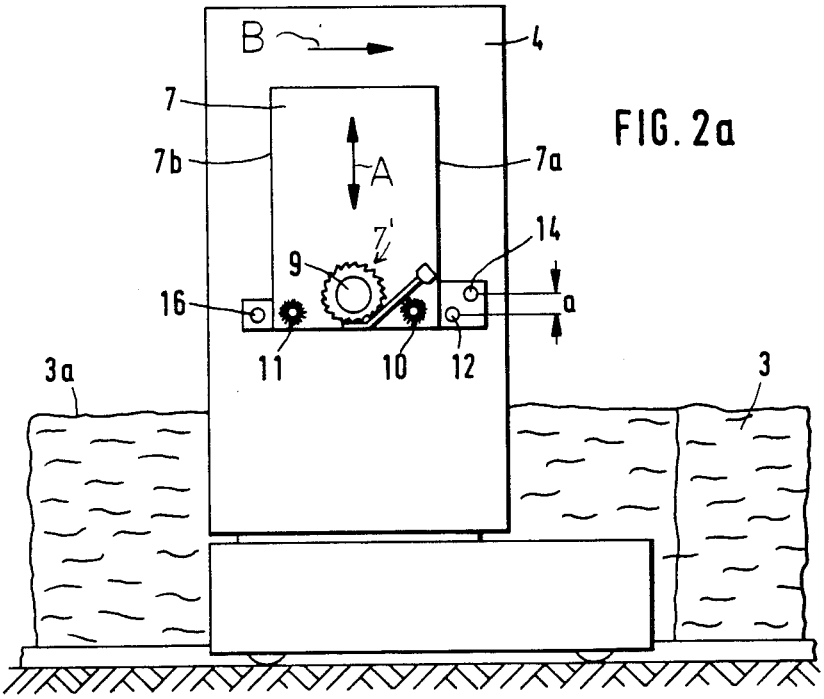
FIG. 2a

METHOD AND APPARATUS FOR OPERATING A BALE OPENER, PARTICULARLY AS A FUNCTION OF THE BALE HEIGHT

BACKGROUND OF THE INVENTION

This invention relates to a method and an apparatus for operating a bale opener, particularly as a function of the height of the textile fiber bales. The fiber opening device of the bale opener travels horizontally in a reciprocating path above the bales of a bale series and removes fiber tufts from the top of the bales. For measuring the height of the fiber bales, a sensor such as an optical barrier or the like is used which performs a plurality of height measurements at the bales. From the measured values a mean value is formed and, after each individual measurement the fiber opening device is automatically moved to the subsequent measuring position.

According to a known process, the opening device travels at a vertical distance from the upper face of the bales and the distance from the fiber bales is measured by an optical barrier of the reflecting light type. The height of the fiber bales is obtained by the difference between the height of the optical barrier (from a reference point) and the distance of the optical barrier from the upper surface of the bale. Such a travel of the opening device consists solely of a measuring pass, during which thus no fiber material is removed from the bales. It is a further disadvantage of this known process that the height of the bales is determined indirectly, that is, as a function of the distance of the measuring member from the upper face of the bales.

SUMMARY OF THE INVENTION

It is an object of the invention to provide an improved method and apparatus from which the discussed disadvantages are eliminated and which, in particular, ensures a high fiber tuft output and a simple determination of the fiber bale height.

These objects and others to become apparent as the specification progresses, are accomplished by the invention, according to which, briefly stated, the height determination is performed simultaneously with the removal of fiber tufts from the fiber bales and the bale height (upper bale boundary) is determined directly by a sensor.

Thus, according to the invention, determination of the fiber bale height is effected simultaneously with the fiber tuft removal, that is, an idling run to serve solely measuring purposes is avoided and, instead, in a predetermined time period, both processes, that is, fiber tuft removal and height measurement are accomplished simultaneously. During the measuring process, the opening device is in operative engagement with the upper face of the fiber bales rather than travelling at a distance therefrom as it has been the case in prior art processes. The arrangement according to the invention provides that the sensor determines the position of the upper bale surface directly. The upper bale boundary is thus followed directly by the sensor, including all surface irregularities. Even during the measuring process, fiber material is removed from the bales, that is, fiber tuft output is not delayed because of the measuring step. Preferably, the upper bale boundary extends between two sensors for effecting height determination.

The apparatus for practicing the invention has a carriage which runs between two fiber bale series and a tower mounted on the carriage for rotation about a vertical axis. The tower has a horizontally projecting cantilever which houses the opening device proper and which thus extends above and across the surface of the fiber bales. A sensor which is mounted on the travelling bale opener and which may be an optical barrier or the lie generates an electric signal which is applied to a control device. The cantilever or the tower carries at least two sensors which are spaced vertically from one another and there is further provided a path or time sensing device for determining the position of the cantilever in its travelling path. It is of importance that the upper bale boundary extend between the two sensors. As soon as such boundary is situated above or underneath both sensors, the position of the sensors is automatically corrected by lowering or raising the same. The sensors may comprise a transmitter and a receiver for sending and receiving visible light, infrared light, ultrasonic waves or the like. The path sensor or time sensor which determines the position of the cantilever, takes into account its dimensions measured in the direction of its travel. Thus, for example, in case one bale is followed by a significantly lower bale, the cantilever part should be lowered onto the lower bale only at a time when the entire cantilever (that is, its dimension measured in the travelling direction) has cleared the higher bale.

According to a further feature of the invention, the sensors are constituted by two optical barriers arranged parallel to the opening device of the bale opener and each having a transmitter and a receiver (detector). The transmitter emits light continuously. In case the upper bale boundary is situated between the two optical barriers, the lower detector is covered while the upper detector is uncovered. The bale height is determined from this position of the optical barriers. If, however, both optical barriers are situated above or underneath the upper bale face, the height level of the optical barriers has to be corrected in such a manner that the bale height boundary again passes between the two optical barriers. Expediently, the optical barriers are situated on the leading face of the cantilever. Preferably, the distance between the two optical barriers is adjustable.

According to a further feature of the invention, the upper light barrier leads the lower light barrier as viewed in the working direction of the bale opener. Preferably, the device for determining the length position of the cantilever is a further optical barrier which is expediently situated on a trailing face of the cantilever. Preferably, for determining the position of the optical barriers in the vertical direction a measuring device is provided. The optical barriers are operatively connected with the control device or the measuring device and the measuring device is connected with the control device. According to another advantageous feature of the invention, the control device is connected with a memory which is preferably of the buffered type to prevent loss of information. Advantageously, the control device is connected with the measuring device for determining the position of the optical barriers in the travelling direction of the bale opener.

BRIEF DESCRIPTION OF THE DRAWINGS

FIG. 1 is a schematic top plan view of a travelling bale opener incorporating a preferred embodiment of the invention.

FIG. 2*a* is a schematic side elevational view of the construction shown in FIG. 1.

DESCRIPTION OF THE PREFERRED EMBODIMENT

Figure 2B:
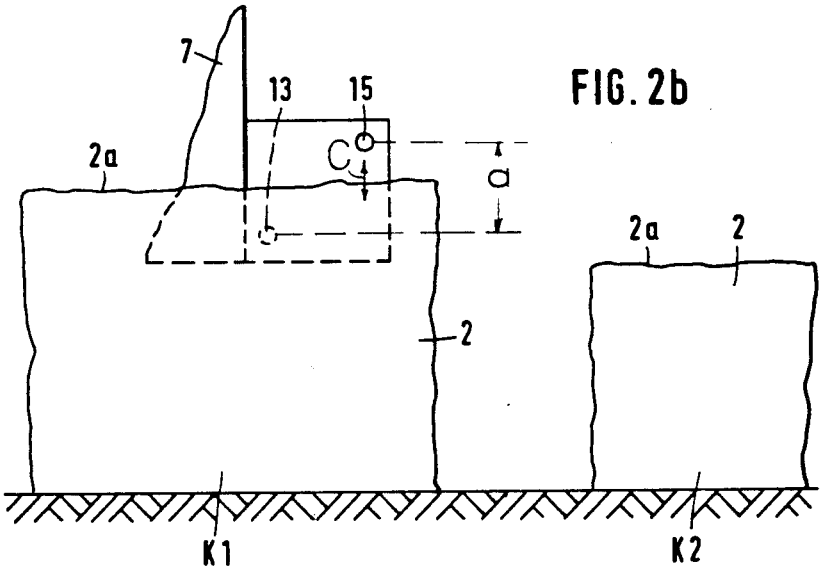
FIG. 2*b* is a schematic side elevational view of some components of the FIG. 2*a* structure.

Turning to FIGS. 1 and 2*a*, there is illustrated a travelling bale opener which may be a "BLENDOMAT" model, manufactured by Trützschler GmbH & Co. KG, Münchengladbach, Federal Republic of Germany. The bale opener serves the purpose of removing fiber tufts from the top of fiber bales of fiber bale series 2 and 3. The bale opener has a tower 4 which is mounted on a carriage 5 which, in turn, is provided with wheels for a back-and-forth travel. The tower 4 has, on one side, a horizontally projecting cantilever 7 which houses the fiber removal device (opening device) proper, generally designated at 7'. The cantilever 7, together with the opening device 7' may move vertically with respect to the tower 4 as indicated by the arrow A. The opening device 7' may comprise a rapidly rotating toothed opening roller 9 for engaging the upper surface of the fiber bales. Underneath the tower 4 there extends a horizontal duct 8 along the travelling direction of the carriage 5 for receiving and pneumatically transporting the removed fiber tufts.

During operation, the carriage 5, together with the tower 4, travels between the fiber series 2 and 3 and the cantilever 7, together with the opening device 7' travels, during each pass, above the one or the other fiber bale series 2 or 3. Starting from the beginning A1 of the bale series 2 the cantilever 7, carried by the carriage 5 travels to the end E1 thereof (forward pass). At the location E1 the tower 4, together with the cantilever 7 and the opening device 7' rotates through 180° about a vertical axis in a clockwise direction as viewed in FIG. 1. Upon such an occurrence, the cantilever 7 will be positioned at the beginning A2 of the bale series 3. From that position, the cantilever 7 travels to the end E2 of the bale series 3 (return pass).

Figure 3:
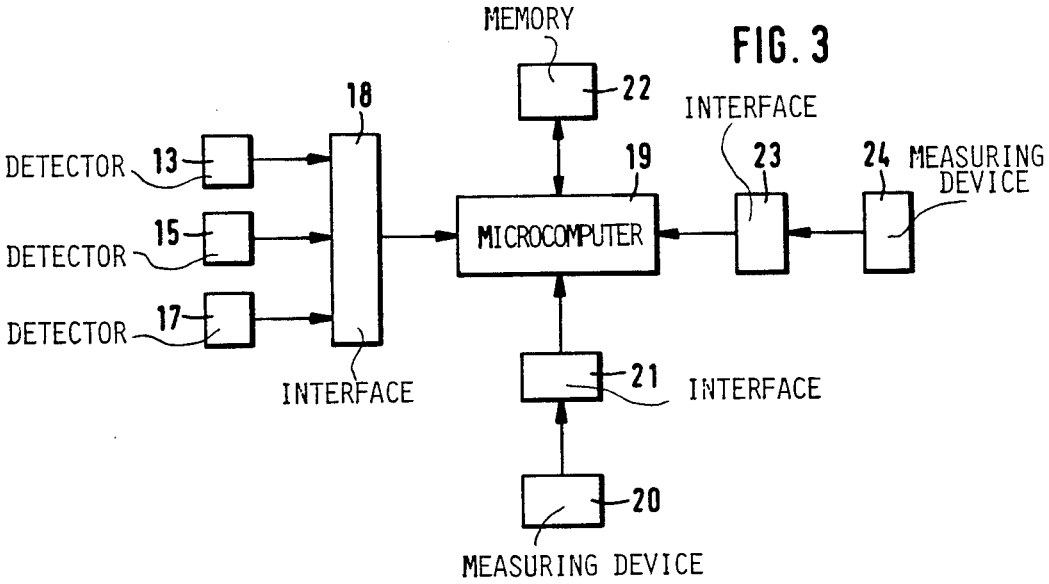
FIG. 3 is a block diagram of circuitry forming part of the preferred embodiment.

On the leading face 7*a* of the cantilever 7 there are arranged a first optical barrier having a transmitter 12 and a detector 13 and a second optical barrier having a transmitter 14 and a detector 15. The transmitters 12 and 14 are aligned with their respective detectors 13 and 15 parallel to the opening roller 9. As seen in FIGS. 2*a* and 3, the optical barriers 12, 13 and 14, 15 are spaced at a distance a from one another. The distance a is adjustable, for example, by adjusting vertically the upper optical barrier 14, 15 in the direction of the arrow C, as shown in FIG. 2*b*. Further, the upper optical barrier 14, 15 is leading the lower optical barrier 12, 13 as viewed in the working direction indicated by the arrow B. Further, for determining the longitudinal position of the cantilever 7 along its travelling path, on the trailing wall face 7*b* of the cantilever 7 a further optical barrier is mounted, having a transmitter 16 and a detector 17.

FIG. 2*b* illustrates a bale series 2 which is composed of two groups K1 and K2, each consisting of a different type of fiber. Each group may comprise a plurality of fiber bales. Between the groups K1 and K2 there is provided a space which is free from fiber material.

Turning now to FIG. 3, the detectors 13, 15 and 17 are connected, by means of an interface 18, with the control device 19 which may be a microcomputer with a microprocessor. The control device 19 may be a TMS model, with a Rockwell 6502 microprocessor, manufactured by Trützschler GmbH & Co. KG, Münchengladbach, Federal Republic of Germany. Further, a measuring device 20 for determining the height position (Y-axis) of the cantilever 7 (and that of the optical barriers 12–15) is connected by means of an interface 21 with the control device 19. The latter, in turn, is connected with a memory 22. Further, the control device 19 is connected to a measuring device 24 by means of an interface 23 for determining the position (X-axis) of the carriage 5 in its travelling path.

In operation, first the cantilever 7 is positioned in such a manner above the beginning of a bale series that upon lowering of the cantilever 7 the opening device 7' contacts the upper surface of the bale series preferably along its entire width (measured in the travelling direction), but at least with the leading support rollers 10. Thereafter, the cantilever 7 is lowered onto the fiber bales until the first optical barrier 12 and 13 senses "dark", that is, the beam of the emitter 12 is interrupted by a fiber bale. The detector 13 informs the control device 19 of this occurrence whereupon the control device 19 requests from the measuring device 20 the height position of the opening device 7' and applies the received information to the memory 22. At the same time, the carriage 5 moves in the direction of the end E1 of the bale series. If the continuity of the light beam between transmitter 12 and detector 13 is reestablished, for example, because there is a dip in the bale surface 2*a*, the cantilever 7 is lowered until the light beam is again interrupted by the bale. The newly obtained value is again stored in the memory 22. Such a lowering, however, is possible only as long as the light beam of the rear light barrier 16 and 17 is uninterrupted. If, by means of a higher bale the light beam of the leading upper optical barrier 14, 15 is interrupted, the carriage 5 remains stationary and the cantilever 7 is raised until the light beam of the optical barriers 14, 15 becomes continuous whereas the light beam of the optical barrier 12, 13 remains interrupted. The new height position is stored and the travel of the bale opener, as well as the measuring process continues. In this manner, upper surface contours of all bale groups K1, K2 of the bale series is determined and stored. Upon reaching the end E1 of the bale series, mean values for the height values determined for the groups K1 and/or K2 are established and stored as starting heights for the groups K1 or K2, respectively. In order to obtain an improved mean value, at predetermined distances a value is repeatedly stored, even if no change in the height position of the cantilever has occurred. Since the mean value is directly dependent from the number of the measured values, the accuracy of the mean value improves with increasing number of measuring values. Further, possible stray values will have less weight. The formula for the mean value is as follows:

$$X = \frac{1}{N} \sum_{i=1}^{N} Xi$$

In case within a bale group K1 or K2 it is determined that height differences exceed a predetermined limit value, the operator will be informed to effect a compensation. In case the operator does not perform such a compensation, then automatically the mean value for the entire bale group K1 or K2 is raised to a height which is below a maximum value by a preselected amount. This prevents an overloading of the bale opener due to an improper set-up of the bales.

The measuring process is performed only once, in the beginning of the opening process.

It will be understood that the above description of the present invention is susceptible to various modifications, changes and adaptations, and the same are intended to be comprehended within the meaning and range of equivalents of the appended claims.

What is claimed is:

1. In a method of operating a bale opener including the steps of moving an opening device of the bale opener in a horizontal direction sequentially above fiber bales of a bale series; measuring the height of each bale by a sensor means upon passage of the opening device; forming a mean value from the sensed individual values, the improvement comprising the steps of operating the opening device for removing fiber tufts from bale tops simultaneously with said measuring step and said measuring step includes a direct sensing of upper bale boundaries by the sensor means.

2. A method as defined in claim 1, wherein said measuring step includes the step of positioning two sensors, situated at different height levels, between the upper bale boundary.

3. A method as defined in claim 1, further comprising the step of altering height positions of said opening device as a function of the individual values upon sensing thereof during the measuring step.

4. A method as defined in claim 3, wherein the sensor means includes two sensors situated at different height levels and travelling with said opening device in unison, said measuring step including the step of altering height positions of said two sensors as a function of the bale height being sensed for seeking to set the two sensors such that they continuously straddle the upper bale boundary.

5. In a bale opener including a carriage arranged for a back-and-forth travel in a path along a fiber bale series; a structure mounted on the carriage; said structure being formed of a tower supported on the carriage and a cantilever mounted on the tower and arranged for vertical displacements with respect to said tower; said cantilever projecting generally horizontally from said tower; an opening device supported in said cantilever and arranged for removing fiber from the bale tops during travel of the carriage; a sensor means arranged for travel along the fiber bale series for emitting first signals characterizing bale heights, a control device operatively connected to said sensor means for receiving said first signals; the improvement wherein said sensor means comprises two sensors mounted on said structure and spaced vertically from one another; further comprising a length position determining device for generating second signals representing longitudinal positions of said cantilever along the travel of said carriage; said length position determining device being connected to said control device for applying said second signals to said control device.

6. A bale opener as defined in claim 5, wherein said opening device comprises an opening roller having a rotary axis; said sensors comprising two optical barriers each having a light transmitter and light detector aligned with the light transmitter parallel to said rotary axis.

7. A bale opener as defined in claim 6, wherein said cantilever has a leading face relative to a direction of travel of said carriage; said optical barriers being mounted on said leading face.

8. A bale opener as defined in claim 6, wherein the vertical distance between the two optical barriers is adjustable.

9. A bale opener as defined in claim 6, wherein the optical barrier situated higher than the other, lower optical barrier leads the lower optical barrier relative to a direction of travel of said carriage.

10. A bale opener as defined in claim 5, wherein said length position determining device comprises an optical barrier.

11. A bale opener as defined in claim 6, wherein said cantilever has a trailing face relative to a direction of travel of said carriage; said optical barrier being mounted on said trailing face.

12. A bale opener as defined in claim 5, further comprising a height position determining device for generating third signals representing height positions of said sensors; said control device being connected to said height position determining device for receiving said third signals.

13. A bale opener as defined in claim 8, wherein said sensors are connected to said control device.

14. A bale opener as defined in claim 12, wherein said sensors are connected to said height position determining device.

15. A bale opener as defined in claim 5, further comprising a memory connected to said control device.

16. A bale opener as defined in claim 15, wherein said memory is a buffered memory.

* * * * *